United States Patent [19]

Nilsson

[11] Patent Number: 5,031,561

[45] Date of Patent: Jul. 16, 1991

[54] STEERING AND MANOEUVERING SYSTEM FOR WATER-BORN VESSELS

[75] Inventor: Kurt Nilsson, Tyresö , Sweden

[73] Assignee: Styr-Kontroll Teknik i Stockholm Aktiebolag, Sweden

[21] Appl. No.: 435,411

[22] PCT Filed: Apr. 27, 1988

[86] PCT No.: PCT/SE88/00213

§ 371 Date: Oct. 30, 1989

§ 102(e) Date: Oct. 30, 1989

[87] PCT Pub. No.: WO88/08390

PCT Pub. Date: Nov. 3, 1988

[30] Foreign Application Priority Data

Apr. 30, 1987 [SE] Sweden ..... 8701810

[51] Int. Cl.[5] ..... B63H 25/42

[52] U.S. Cl. ..... 114/144 R

[58] Field of Search ..... 114/144 R, 144 E; 440/53

[56] References Cited

U.S. PATENT DOCUMENTS 3,976,023 8/1976 Noguchi et al. ..... 114/144 E 4,220,111 9/1980 Krauthkremer ..... 114/144 E 4,519,335 5/1985 Krauthkremer ..... 114/144 E X

FOREIGN PATENT DOCUMENTS 0035859 9/1981 European Pat. Off. .

*Primary Examiner*—Sherman Basinger

*Attorney, Agent, or Firm*—Eckert Seamans, Cherin & Mellott

[57] ABSTRACT

Steering and manoeuvering system for water-borne vessels with two individually turnable propulsion units aranged mutually spaced athwartships in the stern portion of the vessel, and including an actuating turning device (7,8) actuable by a steering control (1), e.g. a lever, such as to maintain the propulsing units parallel during turning in normal sailing of the vehicle ahead or astern, i.e. in the so-called normal steering mode, and an actuating drive device (9,10) for setting the propulsive power and direction ahead/astern of the respective propulsion unit, said drive device being actuable by a power control (2). The system is switchable between said normal steering mode (3) and at least one special manoeuvering mode (4,5), in which the two propulsion units achieve a force resultant directed substantially athwartships for athwartships and/or turning movement of the vessel.

12 Claims, 4 Drawing Sheets

STEERING AND MANOEUVERING SYSTEM FOR WATER-BORN VESSELS

BACKGROUND OF THE INVENTION

1. Field of the Invention

The invention relates to a steering and manoeuvering system for water-born vessels with two individually turnable propulsion units arranged at the stern portion of the vessel and mutually spaced athwartships. These units may be such as jet units, turnable so-called thrusters or turnable propeller units of the "AQUAMATIC", "Z-DRIVE" type or the like, (but not propeller units with a stationary propeller shaft and a separate rudder).

2. Prior Art

A first type of known steering and manoeuvering system for vessels with such double propulsion units includes an actuating turning device, which is actuable by a steering control, e.g. a lever or a wheel, and keeps the propulsion units parallel while being turned, and an actuating drive device, which is actuable by a power control for adjusting the propulsive power ahead or astern of the respective propulsion unit. The vessel can thus be steered for sailing ahead or astern in a desired starboard/port direction, as well as for executing a rotating or turning movement (one unit set for propulsion ahead and the other one for propulsion astern) which can be to advantage in manoeuvering in ports, harbours and other cramped situations. It is not possible to achieve pure athwartships movement with such a system, however. Athwartships movement namely requires that both propulsion units can be turned in opposite angular directions with opposing directions of propulsion.

In a second type of known steering and manoeuvering system (U.S. Pat. No. 3,976,023) all steering functions are achieved by a single controlling joystick which is movable in two dimensions. When the joystick is moved forwards/backwards the combined propulsion effect is increased ahead or astern (by different adjustments of the turning angle) and when the joystick is moved sideways port/starboard steering action is achieved to port or starboard. The power of the propulsion units can be regulated at the same time by pulling out or depressing a knob on the joystick. Turning and athwartships movement of the vessel can be achieved for certain positions of the joystick.

Such a steering and manoeuvering system can indeed appear to be simple, since only one lever is used, but even so it requires that the steersman of the vessel with this system is given extensive training in order to master different manoeuvres, particularly manoeuvers in harbours and ports. In addition, with this system it is difficult to compensate for external forces, e.g. those coming from wind and current, which act on the vessel in a translatory and/or rotary direction.

SUMMARY OF THE INVENTION

The object of the present invention is to achieve a steering and manoeuvering system of the first type mentioned above, which furthermore enables a person to execute complicated special manoeuvers after only having passed a short training course. In normal sailing, it shall thus be possible to steer the vessel to port or starboard conventionally with the aid of a control such as a wheel or lever, while the power control is utilized in a way which is easily understood and natural, from the aspect of logical control, in the execution of special manoeuvers.

This object is achieved by the invention in that the steering and manoeuvering system includes a function selector with the aid of which the system is switchable between a normal steering mode, where the propulsion units are kept parallel during steering, and at least one special manoeuvering mode, where the steering control is disconnected from its normal steering function and said actuating turning device is instead actuated automatically irrespective of the position of the steering control for setting the two propulsion units at symmetrical turning angles in opposite directions so that the two propulsion units achieve a force resultant directed substantially athwartships for athwartships and/or turning movement of the vessel, while said actuating drive device is actuated for setting the two propulsion units in opposing propulsive directions ahead/astern.

By the automatic setting of the angular positions of the propulsion units in the special manoeuvering mode, the steersman can concentrate on relatively simple control functions, such as increasing or decreasing the turning or athwartships movement rate, with the aid of the power control. It has been found that such manoeuvering can be carried out extremely simply, but still exactly and effectively, and since normal sailing takes place conventionally with the aid of the steering and power controls, the steersman can quickly learn to master the steering and manoeuvering system in accordance with the invention.

The special manoeuvering modes can suitably be an athwartships movement mode and a turning mode.

In the respective special manoeuvering mode (turning or athwartships movement) the steering control is preferably utilized to adjust the turning angle of the propulsion units such that the turning angles are changed symmetrically in opposite directions while retaining symmetry, whereby the point of action of the force resultant is moved along the fore and aft line of the vessel or an extension of this line. In the athwartships mode, the steersman can thus readily achieve either a compensating torque, if the vessel is acted on by outside forces as a result of wind or current, or a superposed turning movement. In the turning mode, such displacement of the force resultant point of action achieves an amplification of weakening of the torque.

Switching between the different modes is preferably achieved with the aid of a manually settable function selector, particularly a preselector switch, which does not switch to the set mode until certain operating or manoeuvering conditions have been met.

The power control can consist either of a conventional double lever control or a special control, which achieves synchronous propulsion power setting, when it is moved in a first dimension, and power balancing by changing the propulsive power in the opposite direction (ahead-astern) of the respective propulsion unit, when it is moved in a second dimension.

BRIEF DESCRIPTION OF THE DRAWINGS

The invention will be described in more detail below with reference to the accompanying drawings, which illustrate two exemplary embodiments.

DETAILED DESCRIPTION OF THE PREFERRED EMBODIMENTS

Figure 1A:
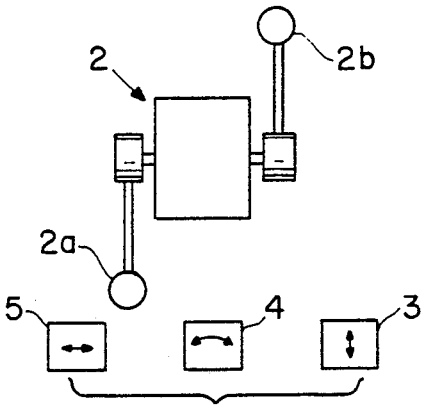
FIG. 1A schematically illustrates a power control unit included in a steering and manoeuvering system according to a first embodiment.
Figure 1C:
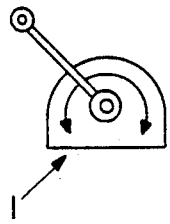
FIG. 1C schematically illustrates a steering control included in a steering and manoeuvering system according to a first embodiment.
Figure 1B:
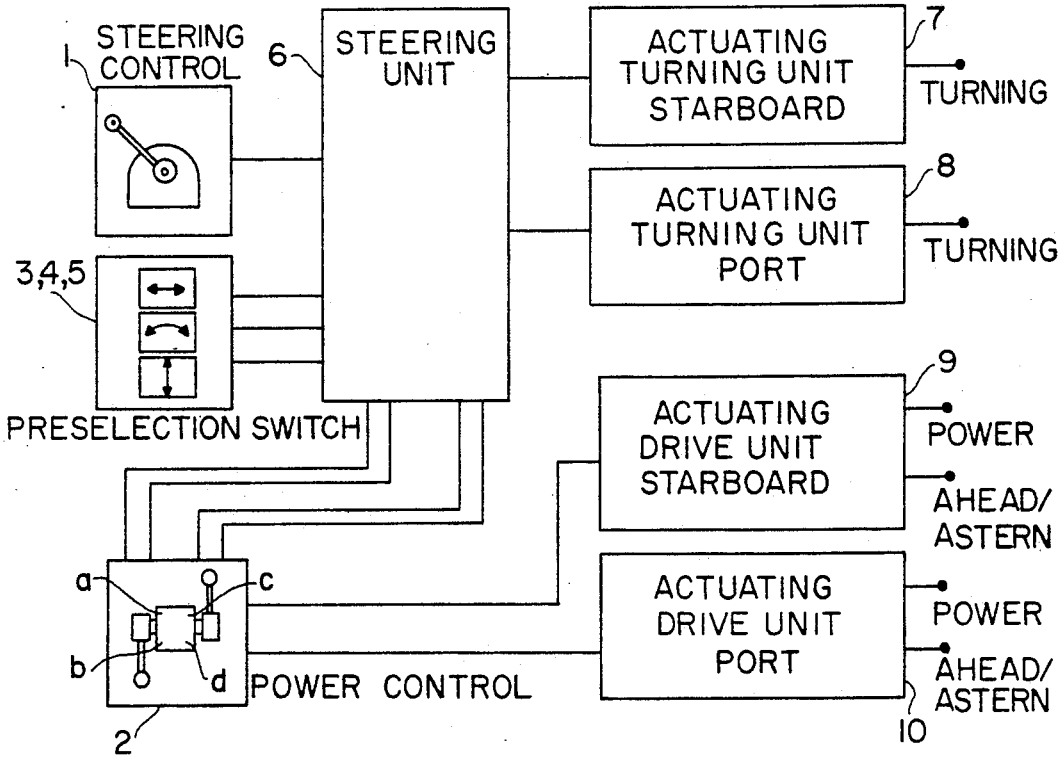
FIG. 1B is a heavily simplified block diagram of the steering and manoeuvering system in its entirety.

A steering and manoeuvering system built up around two conventional components is illustrated in FIGS. 1A, 1B and 1C, namely a steering control 1 in the form of a lever for steering a vessel to starboard or port and a double lever control 2 for controlling propulsion power (engine power) and propulsion direction (ahead-/astern) of the starboard and port propulsion units. The steering and manoeuvering system can thus be installed by connection to an existing equipment. In addition, a function selector is fitted, this being in the form of a preselection switch with three buttons 3, 4, 5 for selecting a normal steering mode, a turning mode or an athwartships movement mode. Position sensing means a, b, c, d (FIG. 1B) are arranged for sensing head or astern positions of each control lever *2a, 2b.*

The steering control 1, the preselection switch 3, 4, 5 and the control lever position sensing means a, b, c, d are connected to an electronic steering unit 6 provided with logical circuits, and which on its output side gives control signals to actuating turning units 7, 8 for angular control of the starboard and port propulsion units, respectively. These turning units 7, 8 are preferably servo controlled units of electromechanical, electrohydraulic or electropneumatic type. The power control 2 is conventionally connected to actuating drive units 9, 10, e.g. by mechanical or hydraulic transmission for acting on the propulsion power (or engine power) and propulsion direction (ahead/astern) of the respective propulsion unit.

The logical circuits of the steering unit 6 decode the incoming signals and actuate both turning units 7, 8 so that the turning angle of the propulsion units correspond to a desired sailing mode and the setting of the steering and power controls.

For the NORMAL steering mode (preselection button 3) the vessel is steered and manoeuvered conventionally, the steering control functioning such that the propulsion units are kept parallel as they are turned, while the propulsion power and direction of the respective propulsion unit can be set individually with the aid of the power control levers *2a, 2b.* This steering mode is generally used for movement ahead, astern or simple manoeuvers.

For relatively complicated manoeuvers such as those needed in harbours, tying up to a quay or pier etc., the preselection buttons 4 and 5 are used for switching onto the turning mode or the athwartships mode, respectively. The parallel relationship of the propulsion units caused by the steering control 1 is disengaged in these special manoeuvering modes, and the steering unit 6 then sets the propulsion units in symmetrical turning angles in opposite directions. A necessary prerequisite for the effectiveness of these special manoeuvering modes is that the propulsive directions of the propulsion units are mutually opposite, i.e. one power lever, e.g. *2a,* is set ASTERN and the other, e.g. *2b,* at AHEAD.

In the TURNING mode (cf. FIG. 3), both propulsion units are directed towards a point astern the vessel on the extension of its fore and aft line. When the steering control 1 is set in neutral position (B and H in the Figure), these turning angles are predetermined by being programmed into the steering unit 6 and result in that the vessel turns to port (position B) or to starboard (position H) about its centre of gravity in the lateral plane. In this mode, the steersman can increase or decrease the rate of turn during the course of manoeuvering by using the levers *2a, 2b* or adjust the angles of the propulsion units (while maintaining symmetry) and thereby displace the point of action in the fore and aft direction with the aid of the steering control 1, see positions A, C, G and I.

In the ATHWARTSHIPS mode both propulsion units are directed towards the centre of gravity of the vessel in the lateral plane, when the steering control 1 is set in the neutral position, see positions E and K. In this case the vessel will be moved exclusively athwartships to port or starboard, provided that wind and current do not cause any torque. If this should be the case, the steersman can apply a compensating torque by a corresponding setting of the steering control 1, the point of action of the force resultant then being displaced fore or aft, see positions D, F, J and L in FIG. 3.

If the levers *2a, 2b* of the power control 2 are in the positions "both ahead", "neutral" or "both stern", (which is sensed by the means a, b, c and d, FIG. 1B), the NORMAL mode is kept engaged, even if one of the buttons 4 or 5 has been depressed. Preselection of the desired special manoeuver mode can thus take place before the intended manoeuver, the mode in question being engaged automatically when the force directions are shifted with the aid of the levers *2a, 2b.* However, changing between the turning and athwartships modes can take place without delay by depressing the respective button 4 and 5 during the manoeuver in progress. Similarly, the NORMAL mode is reengaged as soon as the button 3 is depressed.

Figure 2A:
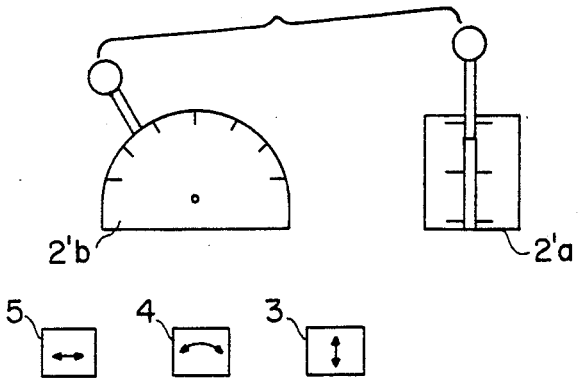
FIGS. 2A, 2B and 2C illustrate in a corresponding way a control unit and a steering and manoeuvering system in accordance with a second embodiment.
Figure 2C:
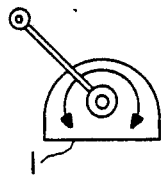
Figure 2B:
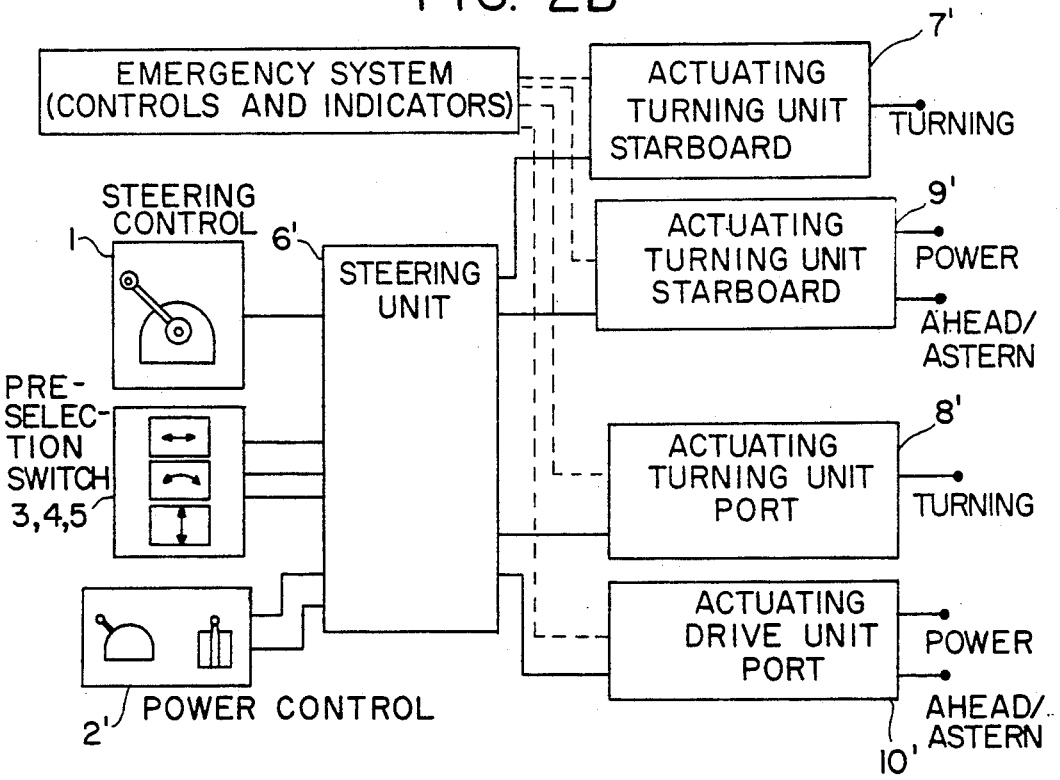
Figure 4:
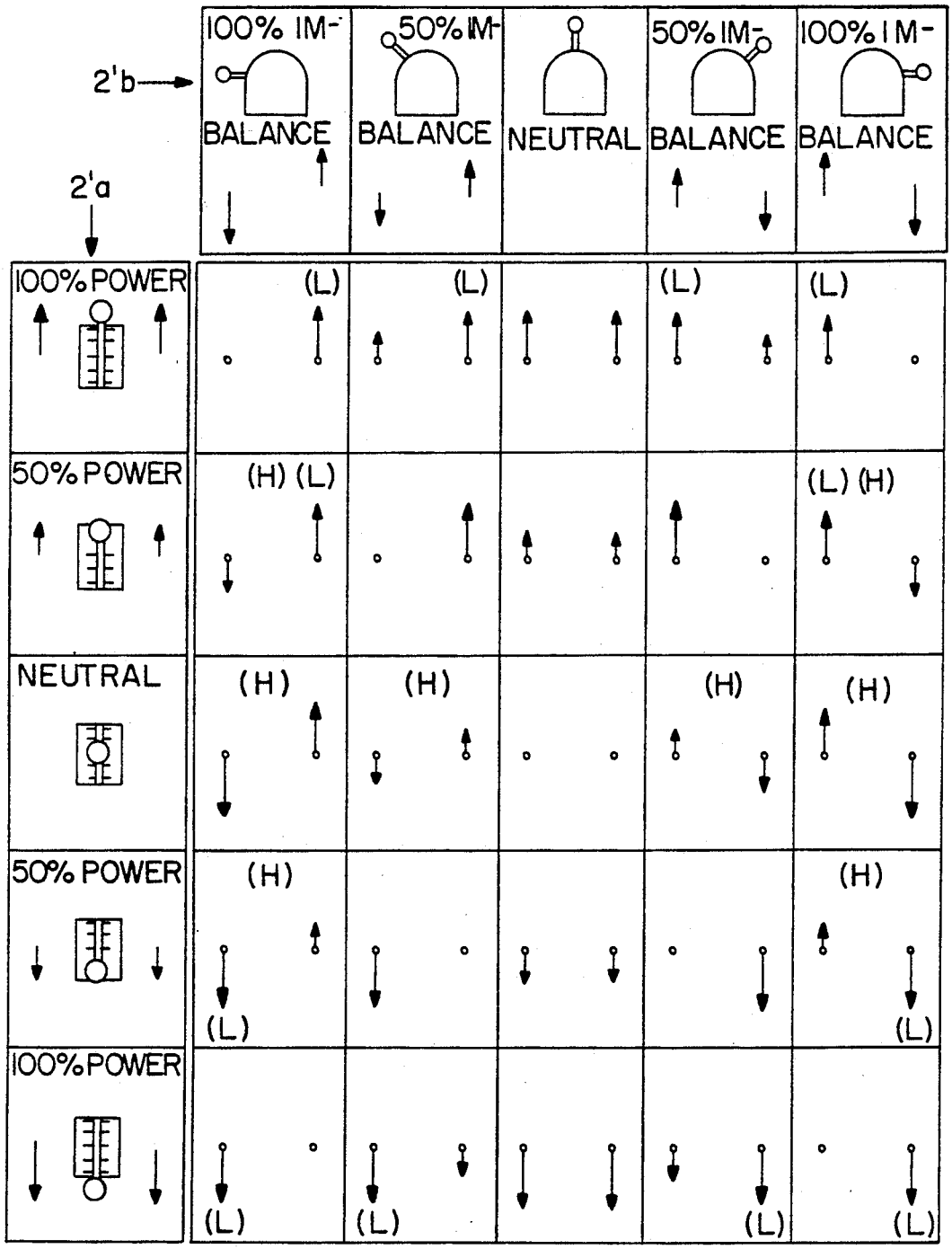
FIG. 4 schematically illustrates how the propulsion power is distributed in the steering and manoeuvering system according to FIGS. 2A, 2B and 2C.

In the steering system according to FIGS. 2A, 2B and 2C there is used a principally similar steering control 1 and the same preselector switches 3, 4, 5 as in FIG. 1A. However, the power control is formed differently and comprises a first lever *2'a* for synchronous setting of the propulsive power (or engine power) ahead/neutral/astern of the propulsion units, and a second lever *2'b* for differential balancing of the propulsive powers/directions (starboard/neutral/port) such that, when the lever *2'a* is in a neutral position and the lever *2'b* is being swung to port, the propulsive power of the port propulsion unit astern is increased and to a corresponding degree that of the starboard propulsion unit is increased ahead, and when swinging the lever *2'b* to starboard, the propulsive power of the starboard propulsive unit is increased astern and that of the port propulsive unit is increased to a corresponding degree ahead. The lever *2'a* is then used to adjust the amount of power while maintaining the vectorial difference between the propulsive powers, ahead or astern, for compensating exterior forces acting in the fore and aft line of the vessel. Co-action between the levers *2'a* and *2'b* and their vectorial effect on power is illustrated in FIG. 4. In FIG. 4, (H) represents that opposing drive directions activate preselected special mode (harbor or manoeuvering mode). (L) represents a vector sum greater than 100% (limited to 100%).

It has been found that a power control according to FIG. 2A is very simple to handle after only a short training course for the person concerned.

In the NORMAL mode the vessel is steered by the steering control 1, and the propulsive power lever 2'a functions as a parallel-connected double lever control, the power balancing lever 2'b achieving increase/decrease of the power of the respective propulsion unit. When the lever 2'b is set in the neutral position, the power on both units is in mutual balance over the entire domain ahead-neural-aster for the lever 2'a. Consequently, the NORMAL mode is retained engaged, even when one of the buttons 4, 5 is depressed.

The preselected special manoeuvering mode is enabled as soon as the lever 2'b is moved to port or starboard sufficiently far for one propulsion unit to propell ahead and the other astern, see the positions (H) in FIG. 4, which corresponds to a double lever control being set with one propulsion unit in the propulsive direction ahead and the other one astern. Both propulsion units are now acted on symmetrically, but with different force directions, when the power is changed by the lever 2'b towards the desired side for athwartships or turning movement.

Figure 3:
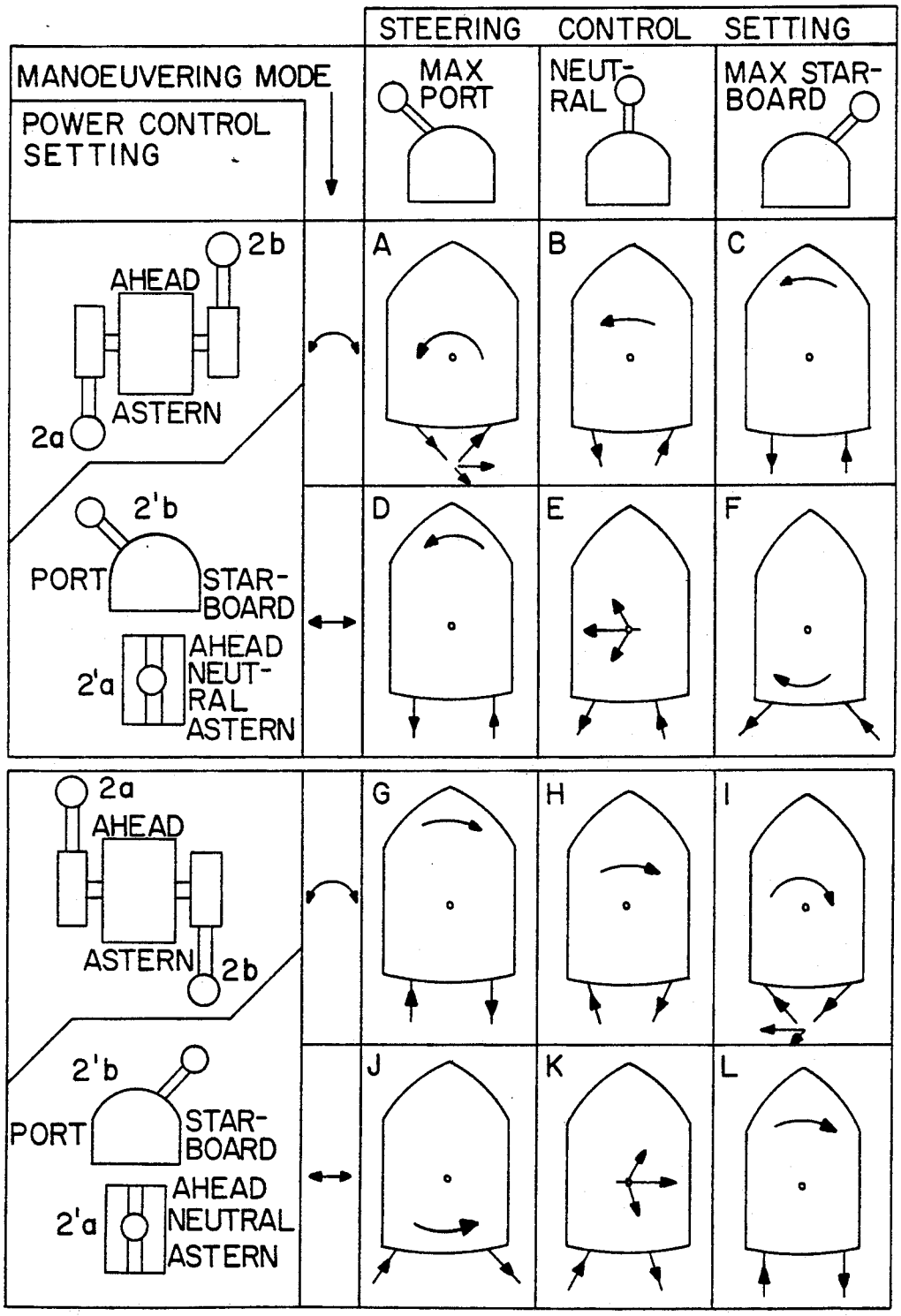
FIG. 3 schematically illustrates how the steering and manoeuvering system in accordance with the invention functions when sailing in two different special manoeuvering modes (turning and athwartships movement)

The steering control 1 can also be utilized in this case for fine adjustment of the point of action of the force resultant in the TURNING or ATHWARTSHIPS modes, as illustrated in FIG. 3. In addition, some propulsive power can be superposed ahead or astern with the aid of the propulsive power lever 2'a for compensating current or wind action in the fore and aft direction of the vessel. The steering and manoeuvering system otherwise functions in a corresponding manner as in the preceding embodiment.

In this case, however, all transmission from the steering control 1, preselector switches 3, 4, 5 and the power control 2' takes place via a central electronic steering unit 6', which controls the two actuating turning units 7', 9' as well as the two actuating drive units 8', 10' for the starboard and port propulsion units. For reasons of safety an emergency system (a so-called back-up-system) with simple individual control means and indicators can also be connected for direct control of the actuating turning and drive units 7'–10'.

The steering and manoeuvering system can be modified by one skilled in the art in many ways within the scope of the following claims. For example, the levers 2'a and 2'b may be replaced by a single lever of the joystick type, which is movable in two dimensions. In addition, it may be sufficient with only one special manoeuvering mode, e.g. TURNING, ATHWARTSHIPS or a combined TURNING/ATHWARTSHIPS mode. Alternatively, three or more special manoeuvering modes can be used. The steering control 1 can be replaced by a wheel. The conditions for initiating a preselected sailing mode can be varied as desired. Finally, preadjusting means can be arranged, suitably placed near the control unit for individually adjusting the ATHWARTSHIPS and TURNING modes, so that the presetting of the turning angles of the propulsion units give the desired effect in the respective special mode (when the steering control is in a neutral position).

I claim:

1. Steering and manoeuvering system for water-born vessels with two individually turnable propulsion units arranged at the stern portion of the vessel and mutually spaced athwartships, including an actuating turning device for controlling the turning angles of the two propulsion units such that they remain mutually parallel in a normal steering mode of the vessel, wherein the vessel is moving ahead or astern, said turning device being actuable by a steering control, and an actuating drive device for setting the propulsive power and direction ahead/astern of the respective propulsion unit, said drive device being actuable by a power control, characterized in that the steering and manoeuvering system includes a function selector with the aid of which the system is switchable between said normal steering mode, and at least one special manoeuvering mode, where the steering control is disconnected from its normal steering function where the propulsion units are kept parallel, and said actuating turning device is instead actuated automatically irrespective of the position of the steering control for setting the two propulsion units at symmetrical turning angles in opposite directions so that the two propulsion units achieve a force resultant directed substantially athwartships, while said actuating drive device is actuated for setting the two propulsion units in opposing propulsive directions ahead/astern; and in that the steering control, in said at least one manoeuvering mode, actuates said actuating turning device such that the turning angles are changed symmetrically in opposite directions, whereby the point of action of the force resultant is displaced along the vessel's fore and aft line, including the linear extensions thereof.

2. Steering and manoeuvering system as claimed in claim 1, characterized in that said at least one special manoeuvering mode includes the following manoeuvering possibilities;

an athwartships movement of the vessel parallel to itself to starboard or port, both propulsion units being kept directed towards the centre of gravity of the vessel in the lateral plane and, in case of outside forces attempting to turn the vessel, towards a point displaced from said centre of gravity along said fore and aft line for compensating said outside forces and a clockwise or anti-clockwise turning of the vessel about said centre of gravity, wherein both propulsion units are kept directed towards a point astern situated on the extension of the fore and aft line of the vessel.

3. Steering system as claimed in claim 2, characterized in that, during said athwartships movement of the vessel, movement of the steering control to starboard achieves displacement of said point of action astern (E–F), when the vessel is moved athwartships to port, and ahead (K–L), when the vessel is moved athwartships to starboard, while movement of the steering control to port achieves displacement of said point of action ahead (E–D), when the vessel is moved athwartships to port, and astern (K–J), when the vessel is moved athwartships to starboard, and in that, during said turning movement of the vessel, a movement of the steering control to starboard achieves displacement of said point of action astern (B–C), when the vessel is turned anti-clockwise, and ahead (H–I), when the vessel is turned clockwise, while a movement of the steering control to port achieves a displacement of said point of action ahead (B–A), when the vessel is turned anti-clockwise, and astern (H–G), when the vessel is turned clockwise.

4. Steering and manoeuvering system as claimed in claim 3, characterized in that the function selector is a preselector switch which does not achieve switching to the set function until certain operational conditions are complied with.

5. Steering and manoeuvering system as claimed in claim 4, characterized in that, in said at least one special manoeuvering mode, the mutual relative positions of the power control levers determine whether the movement takes place to starboard or port.

6. Steering and manoeuvering system as claimed in claim 4, characterized in that said steering control, said function selector and said position sensing means are connected to a steering unit which actuates said actuating turning device, whereas said power control is connected to said actuating drive device without the intermediary of said steering unit.

7. Steering and manoeuvering system as claimed in claim 6, characterized in that the power control includes two separate levers, one for each of said dimensions.

8. Steering and manoeuvering system as claimed in claim 6, characterized in that a necessary condition for switching from said normal steering mode to a special manoeuvering mode is that the power control is set such that one propulsion unit is propulsive ahead and the other astern.

9. Steering and manoeuvering system as claimed in claim 4, characterized in that said steering control, said function selector and said power control are connected to a steering unit which controls said actuating turning device as well as said actuating drive device.

10. Steering and manoeuvering system as claimed in claim 1, characterized in that the function selector is manually settable for selecting any one of said normal steering mode and said at least one special manoeuvering mode.

11. Steering and manoeuvering system as claimed in claim 1, wherein said power control is constituted by a conventional combined control with two parallel, movable levers adjacent each other, each of which is connected to a respective propulsion unit, characterized in that position sensing means are arranged for sensing the ahead or astern position of each lever, and in that a necessary condition for switching from said normal steering mode to said at least one special manoeuvering mode is that one lever assumes a position of ahead and the other lever assumes a position of astern.

12. Steering and manoeuvering system as claimed in claim 1, characterized in that the power control is settable in two dimensions, namely in a first dimension for synchronous setting of the propulsive power ahead/neutral/astern of both propulsion units and in a second dimension for differential power balancing starboard/neutral/port between the two propulsion units.

* * * * *